US011075505B2

(12) United States Patent
Yasuoka et al.

(10) Patent No.: US 11,075,505 B2
(45) Date of Patent: Jul. 27, 2021

(54) IONIZER INCLUDING A DISCHARGE NEEDLE AND A CARRYING AIR JET MECHANISM

(71) Applicant: SMC CORPORATION, Chiyoda-ku (JP)

(72) Inventors: Takashi Yasuoka, Moriya (JP); Suguru Konno, Tsukubamirai (JP); Gen Tsuchiya, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 190 days.

(21) Appl. No.: 16/139,378

(22) Filed: Sep. 24, 2018

(65) Prior Publication Data

US 2019/0123519 A1 Apr. 25, 2019

(30) Foreign Application Priority Data

Oct. 19, 2017 (JP) ..... JP2017-202768

(51) Int. Cl.

| | |
|---|---|
| ***H01T 23/00*** | (2006.01) |
| ***H01T 19/04*** | (2006.01) |
| ***H05F 3/04*** | (2006.01) |
| ***H01T 19/00*** | (2006.01) |

(52) U.S. Cl.

CPC ..... *H01T 23/00* (2013.01); *H01T 19/00* (2013.01); *H01T 19/04* (2013.01); *H05F 3/04* (2013.01)

(58) Field of Classification Search

CPC ..... H01T 23/00; H01T 19/00; H01T 19/04; H05F 3/04

See application file for complete search history.

(56) References Cited

U.S. PATENT DOCUMENTS 4,417,293 A * 11/1983 Larigaldie ..... H05F 3/04 361/212
8,779,382 B1 * 7/2014 Tsai ..... H01T 23/00 250/426
9,683,962 B2 * 6/2017 Janka ..... G01N 1/2252
(Continued)

FOREIGN PATENT DOCUMENTS

JP 2004-95271 3/2004
JP 2004-127858 A 4/2004
(Continued)

OTHER PUBLICATIONS

Extended European Search Report dated Feb. 25, 2019 in Patent Application No. 18194585.8, 5 pages.

*Primary Examiner* — Fred E Finch, III
*Assistant Examiner* — Kevin H Sprenger
(74) *Attorney, Agent, or Firm* — Oblon, McClelland, Maier & Neustadt, L.L.P.

(57) ABSTRACT

An ionizer includes a discharge needle, a discharge needle holder holding the discharge needle, and a carrying air jet mechanism jetting out ion-carrying air toward a charge cancellation target. The carrying air jet mechanism is disposed at a position adjacent to the discharge needle holder, and it includes a drive nozzle having a drive air jet port, and a diffuser disposed in front of the drive nozzle with an ambient air suction gap interposed therebetween. A carrying air flow hole is formed inside the diffuser to be coaxial with the drive air jet port, and a carrying air jet port from which the carrying air is jetted out is formed at a fore end of the carrying air flow hole.

8 Claims, 7 Drawing Sheets

(56) References Cited

U.S. PATENT DOCUMENTS

| | | | | |
|---|---|---|---|---|
| 2005/0083633 | A1* | 4/2005 | Riebel | B03C 3/68 361/227 |
| 2005/0116167 | A1 | 6/2005 | Izaki et al. | |
| 2009/0168287 | A1 | 7/2009 | Fukai et al. | |
| 2013/0161512 | A1 | 6/2013 | Fukada | |
| 2014/0061500 | A1* | 3/2014 | Yang | H01J 49/24 250/424 |

FOREIGN PATENT DOCUMENTS

| | | |
|---|---|---|
| JP | 2004-228069 | 8/2004 |
| JP | 2006-236587 A | 9/2006 |
| JP | 2012-54088 | 3/2012 |

* cited by examiner

IONIZER INCLUDING A DISCHARGE NEEDLE AND A CARRYING AIR JET MECHANISM

TECHNICAL FIELD

The present invention relates to an ionizer for use in cancelling charges of a charge cancellation target that is charged with static electricity.

BACKGROUND ART

An ionizer is used to remove (or cancel) static electricity from a charge cancellation target that is charged with the static electricity. Such an ionizer includes a discharge needle causing corona discharge and generating ions upon application of a high voltage, and the ionizer neutralizes the static electricity by spraying the ions, which have been generated from the discharge needle, to the charge cancellation target in a state that the ions are carried on an air flow jetted from a nozzle. An alternate-current (AC) type ionizer has a structure including one discharge needle, and alternately generates positive and negative ions upon application of an AC high voltage to the one discharge needle. A direct-current (DC) type ionizer has a structure including two discharge needles, and generates positive ions upon application of a positive DC high voltage to one of the two discharge needles and negative ions upon application of a negative DC high voltage to the other discharge needle.

In order to efficiently carry the ions generated from the discharge noodle to the charge cancellation target with the air flow, various contrivances for generating air flows at flow rates and flow speeds suitable for carrying the ions are proposed in related-art ionizers as disclosed in Patent Literatures (PTLs) 1 to 3, for example.

In PTL 1, a nozzle includes an ion generation chamber in which a discharge electrode is disposed, and four air passage holes surrounding the ion generation chamber. Air is released from the air passage holes toward the front of a nozzle, whereby ions released from the ion generation chamber toward the front of the nozzle are caused to fly over a wide range in a state that the ions are carried on air flows from the air passage holes.

In the above first related art, however, because compressed air is jetted through the four air passage holes, increasing supply pressure of the compressed air or increasing diameters of the air passage holes is required in order to increase the flow rate and the flow speed of the compressed air, and to enhance a charge cancellation capability. This results in a problem that the consumption of the compressed air increases.

In PTL 2, four ejection ports are formed to surround an accommodation hole in which a discharge electrode is accommodated, compressed air is jetted from the ejection ports into an air amplification chamber to which the accommodation hole is opened, and the compressed air is jetted through a release hole, which is communicated with the air amplification chamber, together with ions generated from the discharge electrode. On that occasion, ambient air is sucked to be taken in through air inlet holes that are formed in the air amplification chamber, and the sucked ambient air is also jetted together. Thus, a flow rate of the air jetted from the release hole is increased.

Also in the above second related art, however, because the compressed air is jetted from the multiple ejection ports, the consumption of the compressed air increases. In addition, because the compressed air is jetted from the ejection ports such that part of the compressed air flows along a needle tip of the discharge electrode at a position near the needle tip, a flow rate of the air flowing near the needle tip at a high speed increases, thus bringing about a possibility that the air flow at the high speed may adversely affect generation of the ions.

In PTL 3, an air release port having a reduced diameter is formed at a fore end of an ion generation chamber in the form of a closed space in which a discharge electrode is accommodated, and an elongate jet tube is connected to the air release port. Air is ejected from an air delivery pipe into the jet tube at a high speed to make pressure within the jet tube negative, thus causing ionized air within the ion generation chamber to be sucked into the jet tube. The sucked ionized air is ejected to the outside from a fore end of the jet tube. On that occasion, ambient air flows into the ion generation chamber from an air flow inlet.

In the above third related art, however, the ions generated from the discharge electrode tend to contact with and adhere to a wall surface of the ion generation chamber, an inner surface of the jet tube, etc., and the generated ions are all sucked in a state converged into the jet tube having a small diameter. Hence positive and negative ions tend to contact with each other and to be neutralized, thus bringing about a possibility that charge cancellation efficiency may degrade with reduction of ions.

CITATION LIST

Patent Literature

[PTL 1] Japanese Unexamined Patent Application Publication No. 2004-228069

[PTL 2] Japanese Unexamined Patent Application Publication No. 2012-54088

[PTL 3] Japanese Unexamined Patent Application Publication No. 2004-95271

SUMMARY OF INVENTION

Technical Problem

The present invention has been made with intent to solve the above-mentioned problems in the related art, and a technical object of the present invention is to enable ions to be efficiently carried toward a charge cancellation target with a small consumption of compressed air.

Solution to Problem

To achieve the above object, an ionizer according to the present invention includes at least one discharge needle causing corona discharge and generating ions upon application of a high voltage, a discharge needle holder holding the discharge needle, and a carrying air jet mechanism jetting out ion-carrying air toward a charge cancellation target.

The discharge needle holder includes a discharge needle accommodation chamber, an auxiliary air flow inlet in communication with a base end portion of the discharge needle accommodation chamber, and an auxiliary air flow outlet opened at a fore end portion of the discharge needle accommodation chamber to be directly communicated with an external space, the discharge needle is accommodated in the discharge needle accommodation chamber in a posture that a needle tip is exposed to the external space directly or through the auxiliary air flow outlet, and an auxiliary air flow gap extending from the auxiliary air flow inlet to the auxiliary air flow outlet is formed between an outer periphery of the discharge needle and inner peripheries of the discharge needle accommodation chamber and the auxiliary air flow outlet. The carrying air jet mechanism includes a drive nozzle having a drive air flow introduction port at a base end thereof and a drive air jet port at a fore end thereof, and a diffuser disposed in front of the drive nozzle with an ambient air suction gap interposed therebetween, the carrying air jet mechanism being disposed at a position adjacent to the discharge needle holder, a carrying air flow hole having a larger diameter than the drive air jet port is formed inside the diffuser to be coaxial with the drive air jet port, and a carrying air jet port from which the carrying air is jetted out is formed at a fore end of the carrying air flow hole.

In the present invention, the drive nozzle and the diffuser in the carrying air jet mechanism are preferably disposed at a position different from a discharge needle axis, which passes a center of the discharge needle, along a nozzle axis parallel to the discharge needle axis.

The ambient air suction gap may be directly communicated with the external space in all directions perpendicular to the nozzle axis, and the carrying air jet port may be directly opened to the external space.

In the present invention, the discharge needle may be an alternate-current discharge needle alternately generating positive and negative ions upon application of an alternate-current high voltage, and one or two carrying air jet mechanisms may be disposed for one discharge needle. As an alternative, the discharge needle may be a direct-current discharge needle generating positive or negative ions upon application of a direct-current high voltage, and one carrying air jet mechanism may be disposed for one pair of positive and negative discharge needles.

In the present invention, preferably, the ionizer further includes a first member and a second member formed separately and coupled to each other, wherein the discharge needle holder and the drive nozzle are provided in the first member, the discharge needle is held by the first member, and the diffuser is provided in the second member.

Desirably, a discharge needle cartridge is formed by the first member, the second member, and the discharge needle, and the discharge needle cartridge is detachably attached to a body of the ionizer. In such a case, the body may be formed by coupling a plurality of body blocks in series in a manner of enabling the number of coupled body blocks to be increased or decreased, and the discharge needle cartridge may be attached to each of the body blocks.

Advantageous Effects of Invention

According to the present invention, with the provision of the carrying air jet mechanism including the drive nozzle and the diffuser, the ion-carrying air can be jetted at a high speed toward the charge cancellation target with an ejector effect of the carrying air jet mechanism in a state that an amount of the ion-carrying air is increased. As a result, the ions can be efficiently carried toward the charge cancellation target with a small consumption of air.

DESCRIPTION OF EMBODIMENTS

Figure 1:
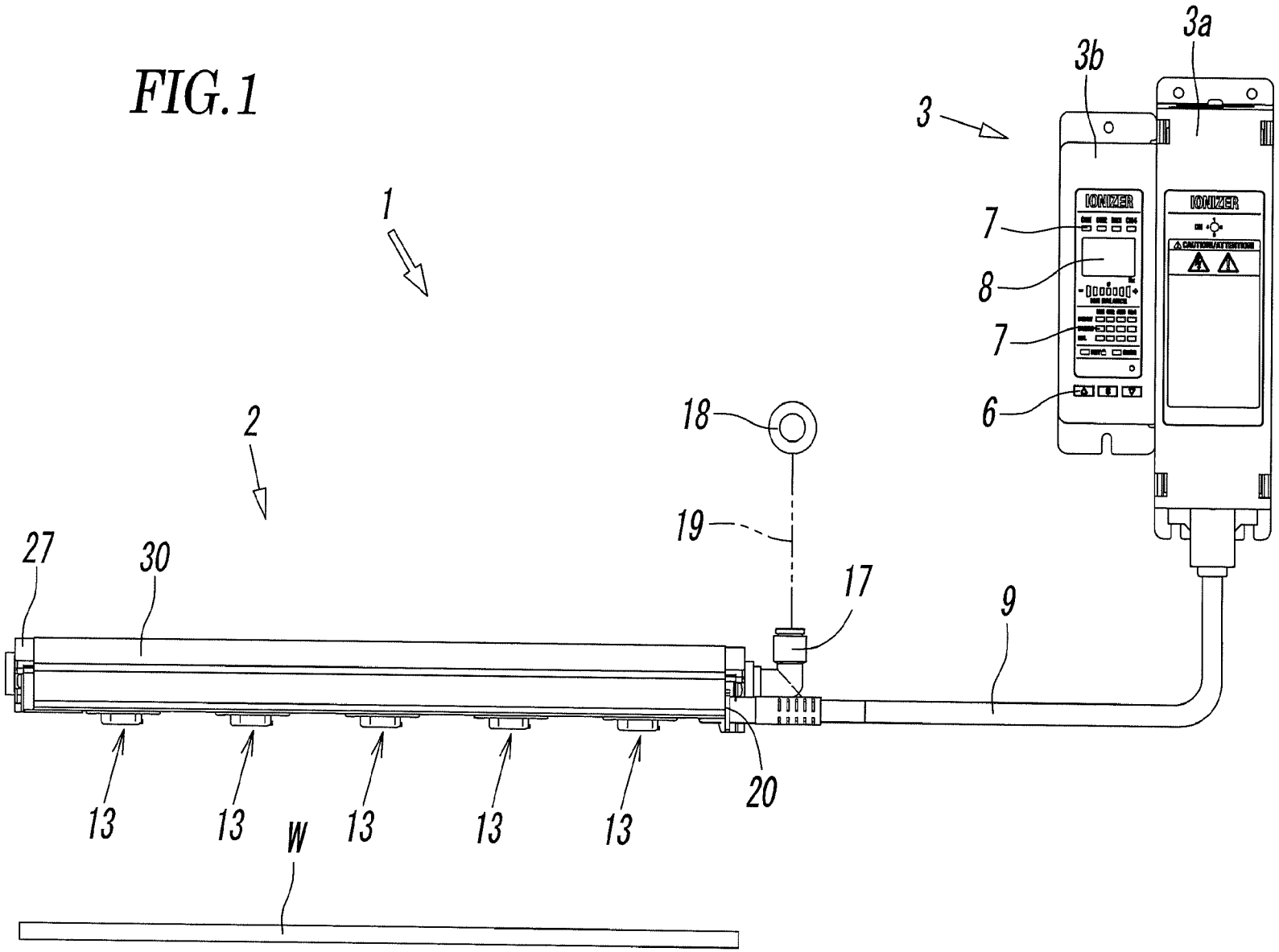
FIG. 1 is a side view of an ionizer according to the present invention.
Figure 2:
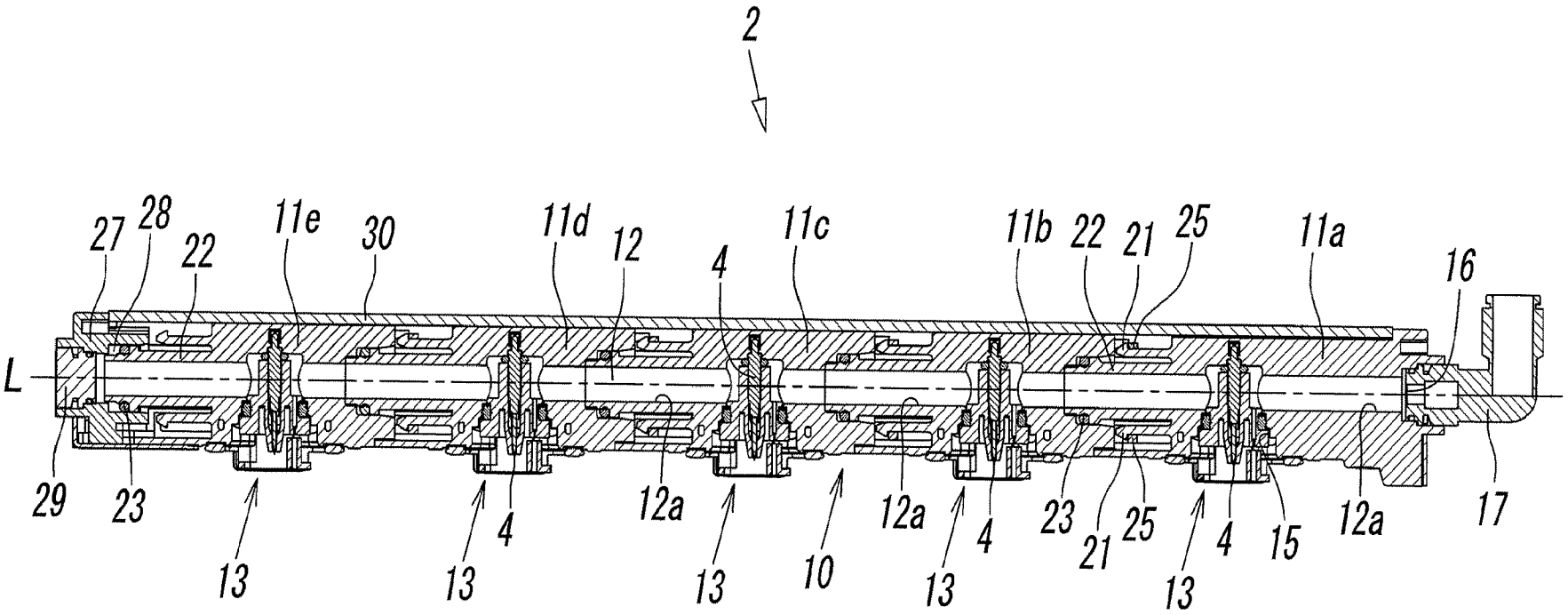
FIG. 2 is a sectional view of an ionizer main unit sectioned in a lengthwise direction at a center position of the ionizer main unit in a widthwise direction.

FIGS. 1 and 2 illustrate one embodiment of an ionizer 1 according to the present invention. The ionizer 1 is used in processing steps for various kinds of works W, such as a semiconductor wafer and a liquid crystal glass, to remove static electricity from the works W that are charged with the static electricity. The ionizer 1 includes an ionizer main unit 2 equipped with a discharge needle 4 causing corona discharge and generating ions upon application of an AC high voltage, and a control panel 3 used for operating the entirety of the ionizer.

The control panel 3 includes a first control panel 3*a* in which an AC high voltage circuit is incorporated, and a second control panel 3*b* equipped with various control buttons 6, lamps 7, a display unit 8, etc. The second control panel 3*b* is attached to a lateral surface of the first control panel 3*a*, and the control panel 3 is electrically connected to the ionizer main unit 2 via a cord 9 extending from the first control panel 3*a*.

The ionizer main unit 2 is of the bar type having an elongate shape and extending along a body axis L, and it includes a body 10. The body 10 is formed by coupling a plurality of body blocks 11*a* to 11*e* in series along the body axis L and in a manner of allowing the number of coupled body blocks to be increased or decreased. An air supply flow path 12 extending along the body axis L is formed inside the body 10. One discharge needle cartridge 13 including the discharge needle 4 is detachably attached to each of the body blocks 11*a* to 11*e*. In an illustrated example, the body 10 is formed by five body blocks 11*a* to 11*e*.

Among the five body blocks 11*a* to 11*e*, the first body block 11*a* positioned on the side nearest to a base end of the ionizer main unit 2 (i.e., on the rightmost side in the drawing) has a structure slightly different from structures of the other second to fifth body blocks 11*b* to 11*e*, and the structures of the second to fifth body blocks 11*b* to 11*e* are the same. The structure of each of the body blocks will be described below.

The first body block 11*a* has a cartridge attachment portion 15 to which the discharge needle cartridge 13 is attached, the cartridge attachment portion 15 having a recessed shape and being formed in a lower surface of the first body block 11*a*. A flow path hole 12*a* penetrates through the inside of the first body block 11*a* from the base end to a fore end of the first body block 11*a* along the body axis L. The flow path hole 12*a* forms part of the air supply flow path 12.

A joint attachment hole 16 for attachment of a pipe joint 17 is formed in a base end portion of the first body block 11*a* to be communicated with an end portion of the flow path hole 12*a*, and a piping tube 19 in communication with a compressed air source 18 is connected to the pipe joint 17 attached to the joint attachment hole 16. Furthermore, a cord connecting portion 20 is formed in the base end portion of the first body block 11*a*, and the cord 9 extending from the control panel 3 is connected to the cord connecting portion 20.

Figure 3:
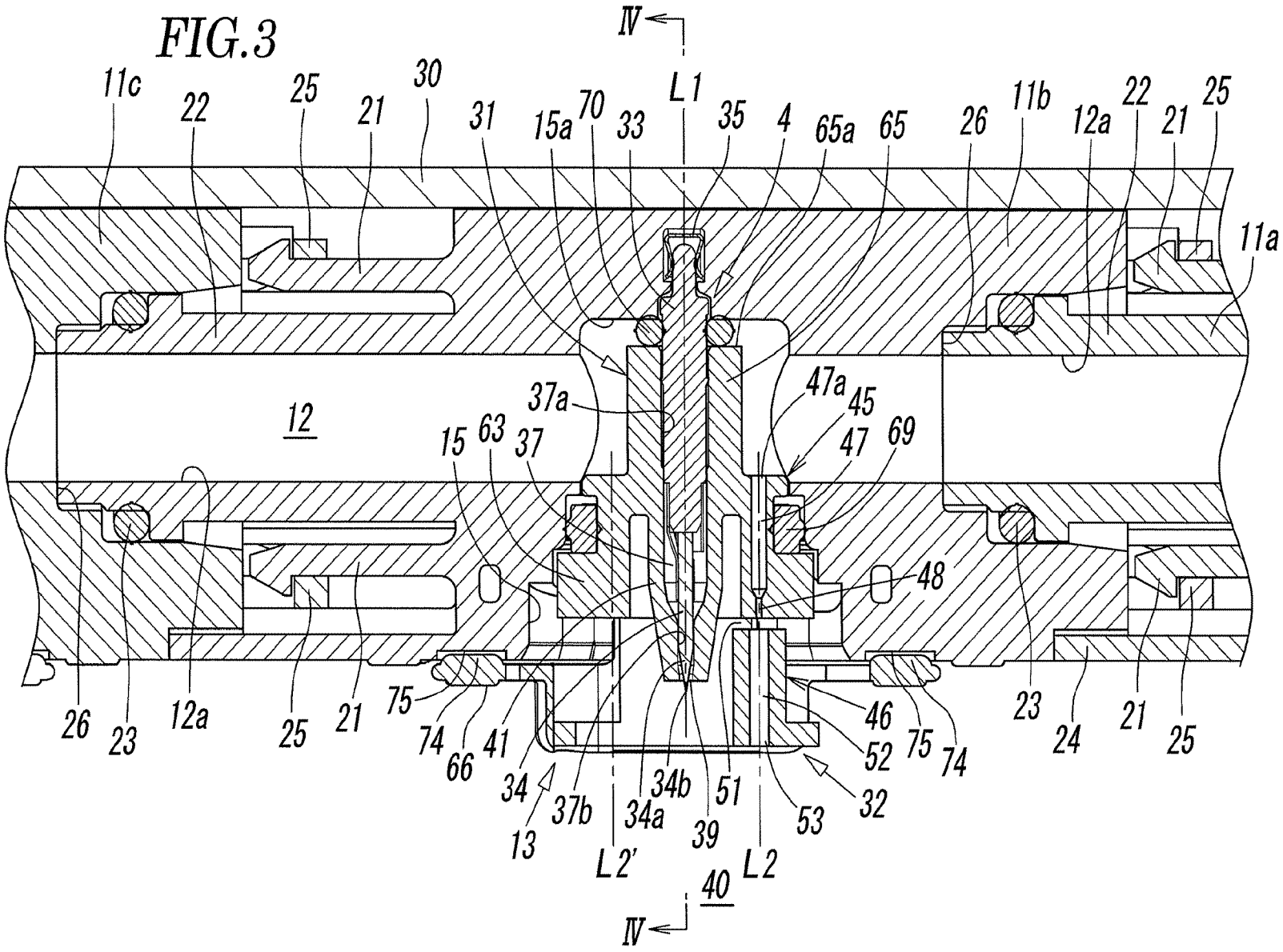
FIG. 3 is an enlarged view of principal part of FIG. 2.

In a fore end portion of the first body block 11*a*, as seen by further referring to FIG. 3, there are formed a pair of elastic engagement pieces 21 that are elastically engaged with a pair of engagement portions 25 of the adjacent second body block 11*b*, a connection pipe portion 22 that is air-tightly fitted to a connection hole 26 of the adjacent second body block 11*b* with a seal member 23 interposed therebetween, and a shield plate 24 that covers, from the lower surface side, a coupling portion formed by the elastic engagement pieces 21. The connection pipe portion 22 communicates the above-described flow path hole 12*a* with a flow path hole 12*a* in the adjacent second body block 11*b*.

On the other hand, the second to fifth body blocks 11*b* to 11*e* are different from the first body block 11*a* only in that the engagement portions 25 and the connection hole 26 are formed in a base end portion of each of the second to fifth body blocks 11*b* to 11*e* instead of the joint attachment hole 16 and the cord connecting portion 20 which are formed in the base end portion of the first body block 11*a*, and that a length of each of the second to fifth body blocks 11*b* to 11*e* in a direction of the body axis L is slightly shorter than a length of the first body block 11*a* in the same direction. Other points are substantially the same as those in the first body block 11*a*. Accordingly, the same components in the second to fifth body blocks 11*b* to 11*e* as those in the first body block 11*a* are denoted by the same reference signs as those used in the first body block 11*a*, and detailed description of the second to fifth body blocks lib to 11*e* is omitted.

An end block 27 closing a fore end of the air supply flow path 12 is attached to a fore end of the fifth body block 11*e*. The end block 27 has a connection hole 28 to which a connection pipe portion 22 of the fifth body block 11*e* is air-tightly fitted with a seal member 23 interposed therebetween, and an opening at a fore end of the connection hole 28 is air-tightly closed by a plug 29. A member denoted by a reference sign 30 in the drawing is a cover for covering an upper surface and lateral surfaces of the body 10. The first to fifth body blocks 11*a* to 11*e* coupled as described above are held in a coupled state by coupling rods 14 (see FIG. 4) penetrating through the insides of the coupled body blocks.

In the following description, when it is not needed to discriminate the first to fifth body blocks 11*a* to 11*e* from each other, those body blocks are each simply called the "body block 11".

The discharge needle cartridge 13 will be described below. As seen by further referring to FIGS. 3 to 8, the discharge needle cartridge 13 includes the discharge needle 4, a discharge needle holder 31 holding the discharge needle 4, and a carrying air jet mechanism 32 jetting out carrying air toward the work W that is the charge cancellation target.

The discharge needle 4 includes a metal-made base end attachment portion 33 having a large diameter, and a metal-made discharge needle body 34 extending from a fore end of the base end attachment portion 33. A conical discharge portion 34*a* having a tapered shape is formed at a fore end of the discharge needle body 34. Upon application of an AC high voltage to the discharge needle 4, the discharge portion 34*a* causes corona discharge and alternately generates positive and negative ions.

When the discharge needle cartridge 13 is attached to the body block 11, the discharge needle 4 comes into contact with a conductive member 36 through a terminal 35 disposed in the body block 11, and is connected the cord 9 via the conductive member 36. Thus, the discharge needle 4 is connected to the AC high voltage circuit in the first control panel 3*a*. The conductive member 36 is disposed in each of the first to fifth body blocks 11*a* to 11*e*. When the body blocks 11*a* to 11*e* are coupled successively, the conductive members 36 in those body blocks are electrically connected successively.

The discharge needle holder 31 includes a discharge needle accommodation chamber 37 which is in the form of a hole and in which the discharge needle 4 is accommodated. The discharge needle accommodation chamber 37 extends along a first axis L1 perpendicular to the body axis L, and it includes a large-diameter portion 37*a* on the base end side, and a small-diameter portion 37*b* continuously extending from a fore end of the large-diameter portion 37*a*. An inner diameter of the small-diameter portion 37*b* is smaller than that of the large-diameter portion 37*a*. Furthermore, an auxiliary air flow inlet 38 in communication with the air supply flow path 12 in the body block 11 is formed to be opened to the large-diameter portion 37*a*, and an auxiliary air flow outlet 39 is opened at a fore end of the small-diameter portion 37*b* to be directly communicated with an external space 40. The small-diameter portion 37*b* is formed in a tip region of a tubular portion 41 having a nozzle shape, and the auxiliary air flow outlet 39 is opened at a fore end of the tubular portion 41.

The discharge needle 4 is accommodated in the discharge needle accommodation chamber 37 in a state that the base end attachment portion 33 is accommodated in the large-diameter portion 37*a* along the first axis L1, and that the discharge needle body 34 is arranged to extend from the large-diameter portion 37*a* to the small-diameter portion 37*b* with a needle tip 34*b* held in a posture slightly projecting to the external space 40 from the auxiliary air flow outlet 39. Thus, the above-described first axis can also be called a discharge needle axis passing the center of the discharge needle 4.

An auxiliary air flow gap 42 extending from the auxiliary air flow inlet 38 to the auxiliary air flow outlet 39 is formed between an outer periphery of the discharge needle 4 and inner peripheries of the large-diameter portion 37*a* and the small-diameter portion 37*b*. The auxiliary air flow gap 42 is narrowed between the base end attachment portion 33 of the discharge needle 4 and the large-diameter portion 37*a* and between the discharge needle body 34 and the small-diameter portion 37*b*. Therefore, a flow rate of air flowing into the auxiliary air flow gap 42 from the air supply flow path 12 is small, and a flow rate of air flowing out to the outside along the needle tip 34*b* of the discharge needle 4 from the auxiliary air flow outlet 39 is also small. As a result, reduction of ion generation efficiency, which may be caused due to an increase of the flow rate and the pressure of air around the needle tip 34*b* of the discharge needle 4, can be prevented, and at the same time adherence of contamination to the discharge portion 34*a* of the discharge needle 4 can be prevented with a fine flow of air.

The needle tip 34*b* of the discharge needle 4 is not always required to be projected to the external space 40 from the auxiliary air flow outlet 39, and it may be positioned in flush with the open end of the auxiliary air flow outlet 39 or may be located at a position slightly retracted from the open end. Thus, the needle tip 34*b* is just required to be positioned in a state facing the external space 40 directly or through the auxiliary air flow outlet 39.

The carrying air jet mechanism 32 includes a drive nozzle 45 and a diffuser 46. The drive nozzle 45 and the diffuser 46 are disposed along a second axis L2, which is parallel to the first axis L1, at a position adjacent to the discharge needle accommodation chamber 37 of the discharge needle holder 31. The second axis L2 can also be called a nozzle axis L2.

The drive nozzle 45 includes a drive air flow hole 47 having a drive air introduction port 47*a* at its base end, and a drive air jet port 48 in continuation with a fore end of the drive air flow hole 47. A diameter of the drive air jet port 48 is smaller than that of the drive air flow hole 47. The drive air introduction port 47*a* is communicated with the air supply flow path 12 in the body block 11.

The diffuser 46 has a circular columnar shape and is disposed in front of the drive nozzle 45 with an ambient air suction gap 51 interposed therebetween. A carrying air flow hole 52 having a larger diameter than the drive air jet port 48 is formed inside the diffuser 46 at a position coaxial with the drive air jet port 48, and a carrying air jet port 53 from which the carrying air is jetted out is formed at a fore end of the carrying air flow hole 52.

Figure 5A:
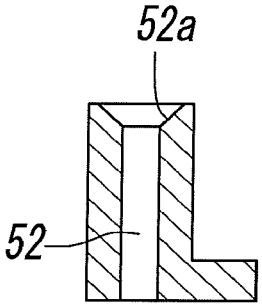
FIG. 5A is a sectional view of principal part, the view illustrating a modification of a hole shape of a carrying air flow hole in a diffuser.
Figure 5B:
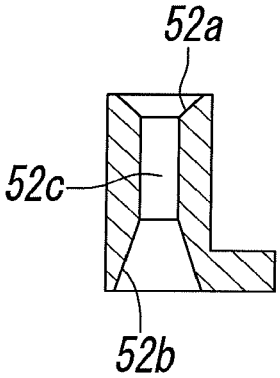
FIG. 5B is a sectional view of principal part, the view illustrating a modification of the hole shape of the carrying air flow hole in the diffuser.
Figure 5C:
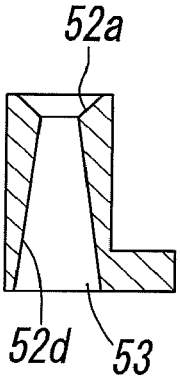
FIG. 5C is a sectional view of principal part, the view illustrating a modification of the hole shape of the carrying air flow hole in the diffuser.

In an example illustrated in FIG. 3, the carrying air flow hole 52 is formed in a shape having a constant inner diameter over an entire length of the carrying air flow hole 52. However, the shape of the carrying air flow hole 52 may be modified such that, as illustrated in FIG. 5A, a base end portion 52*a* has a conical surface gradually spreading outward, or that, as illustrated in FIG. 5B, each of the base end portion 52*a* and a fore end portion 52*b* has a conical surface gradually spreading outward, and that an intermediate portion 52*c* has a constant inner direction. Alternatively, as illustrated in FIG. 5C, the base end portion 52*a* may have a conical surface gradually spreading outward, and a portion 52*d* spanning from the base end portion 52*a* to the carrying air jet port 53 may have a shape gradually spreading outward in its entirety. In such a case, an inner surface of the portion 52*d* gradually spreading outward may have a linear shape toward the carrying air jet port 53, or may be formed as a curved surface projecting to the inner side of the hole.

A position at which the ambient air suction gap 51 is formed is present rearward of both the open end of the auxiliary air flow outlet 39 and the needle tip 34*b* of the discharge needle 4, and a position at which the carrying air jet port 53 is formed is present forward of both the open end of the auxiliary air flow outlet 39 and the needle tip 34*b* of the discharge needle 4. Furthermore, the ambient air suction gap 51 and the carrying air jet port 53 are directly communicated with the external space 40 without passing through a restriction flow path in which a pressure loss is increased with narrowing of a cross-sectional area, the pressure loss being provided, for example, by passing through a hole. In other words, the ambient air suction gap 51 is directly communicated with the external space 40 in all directions (i.e., over an entire periphery of the diffuser 46) perpendicular to the second axis L2, and the carrying air jet port 53 is directly opened to the external space 40.

The carrying air jet mechanism 32 has the function as an ejector. When drive air supplied from the air supply flow path 12 is blown into the carrying air flow hole 52 of the diffuser 46 at a high speed from the drive air jet port 48 of the drive nozzle 45, the inside of the carrying air flow hole 52 is brought into a negative pressure state. Therefore, air in the external space 40 is sucked into the carrying air flow hole 52 through the ambient air suction gap 51, and is jetted out from the carrying air jet port 53 together with the drive air from the drive nozzle 45.

Figure 6:
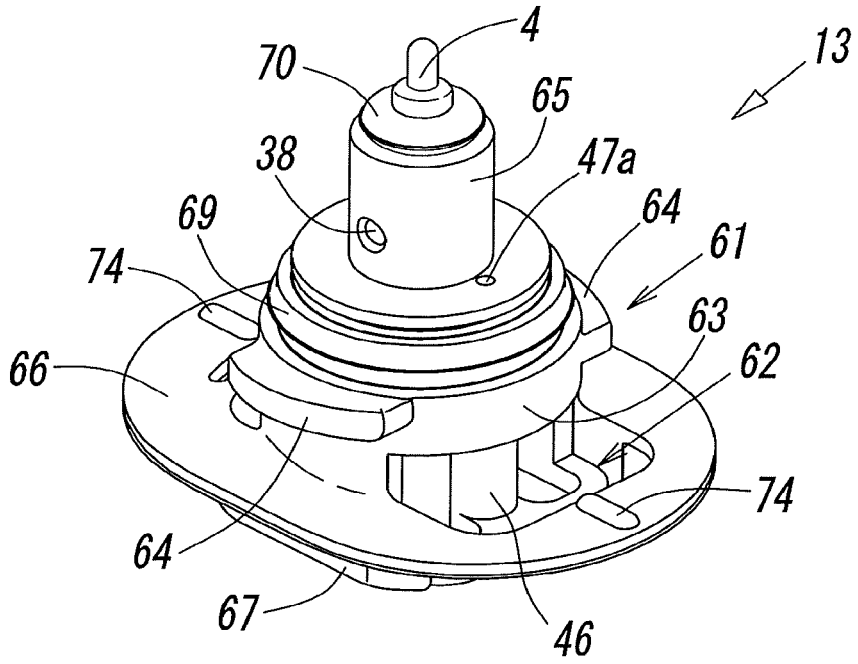
FIG. 6 is a perspective view when looking at a discharge needle cartridge from an obliquely upward direction.
Figure 7:
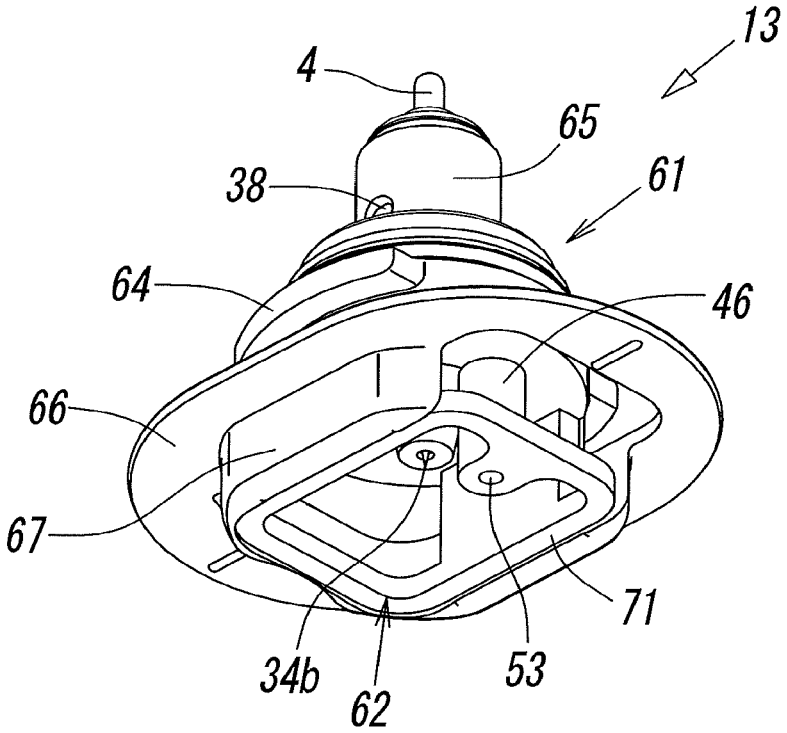
FIG. 7 is a perspective view when looking at the discharge needle cartridge from an obliquely downward direction.
Figure 8:
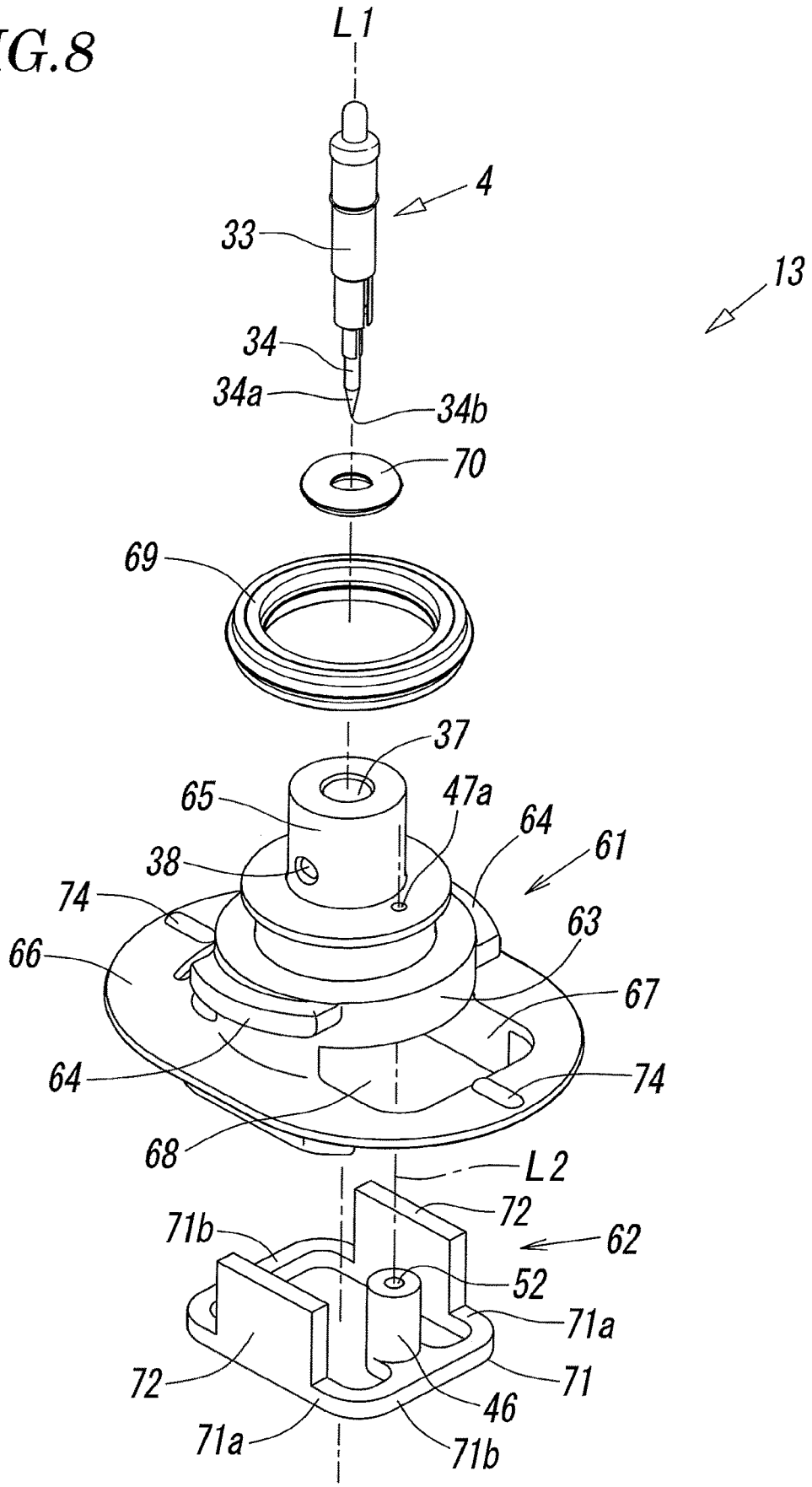
FIG. 8 is an exploded perspective view of the discharge needle cartridge of FIG. 6.

From the viewpoint of simplifying and rationalizing structures of the discharge needle holder 31 and the carrying air jet mechanism 32, as seen from FIGS. 6 to 8, the discharge needle cartridge 13 is formed by coupling a first member 61 and a second member 62 to each other, which are separately made of a synthetic resin. The discharge needle holder 31 and the drive nozzle 45 are formed integrally with the first member 61, and the discharge needle 4 is held by the first member 61. The diffuser 46 is formed integrally with the second member 62.

For example, a PBT resin (polybutylene terephthalate resin) or an ABS resin (acrylonitrile-butadiene-styrene copolymer resin) can be used as the synthetic resin.

The first member 61 includes a main barrel portion 63 having a circular columnar shape, a pair of engagement projections 64 and 64 formed respectively on opposite lateral surfaces of the main barrel portion 63 in a diametrical direction, a circular columnar portion 65 extending upward from an upper end of the main barrel portion 63 along the first axis L1, a flange portion 66 having a substantially elliptic shape and formed in a lower end portion of the main barrel portion 63, a frame portion 67 having a substantially C-shape and being in continuation with a lower surface of the flange portion 66, and a cutout portion 68 through which an inner space of the frame portion 67 and an upper space of the flange portion 66 are communicated with each other.

An outer diameter of the circular columnar portion 65 is smaller than that of the main barrel portion 63, and a diameter of the flange portion 66 in a minor-axis direction is larger than the outer diameter of the main barrel portion 63. The engagement projections 64 are each gradually inclined along a circumferential direction of the main barrel portion 63, and a direction of the inclination of the engagement projection 64 is the same as that of threads of a right-hand screw. Moreover, an annular main seal member 69 is fitted over an outer periphery of the main barrel portion 63, and an O-ring 70 is fitted over part of an upper end portion of the discharge needle 4, the part projecting upward from the circular columnar portion 65.

The discharge needle accommodation chamber 37 is formed inside both the circular columnar portion 65 and the main barrel portion 63, the auxiliary air flow inlet 38 is formed in a lateral surface of the circular columnar portion 65, and the fore end of the tubular portion 41 extends into an inner space of the frame portion 67. Furthermore, the drive air flow hole 47 of the drive nozzle 45 is formed inside the main barrel portion 63 at a position adjacent to the discharge needle accommodation chamber 37, and the drive air flow introduction port 47*a* is opened at an upper surface of the main barrel portion 63.

On the other hand, the second member 62 includes a body portion 71 having a rectangular frame-like shape, and a pair of plate-like portions 72 rising from one pair of opposing frame sides 71*a* and 71*a* of the body portion 71 parallel to the first axis L1. The diffuser 46 is formed integrally with one of the other pair of opposing frame sides 71*b* and 71*b* of the body portion 71 along the second axis L2.

The discharge needle cartridge 13 is assembled by inserting the second member 62 into the frame portion 67 of the first member 61, and by fixing the second member 62 in place. At that time, the fixing of the first member 61 and the second member 62 is made by biting a small engagement projection, which is formed on an outer surface of the body portion 71 of the second member 62, into an inner surface of the frame portion 67 of the first member 61 to be tightly held there.

Figure 4:
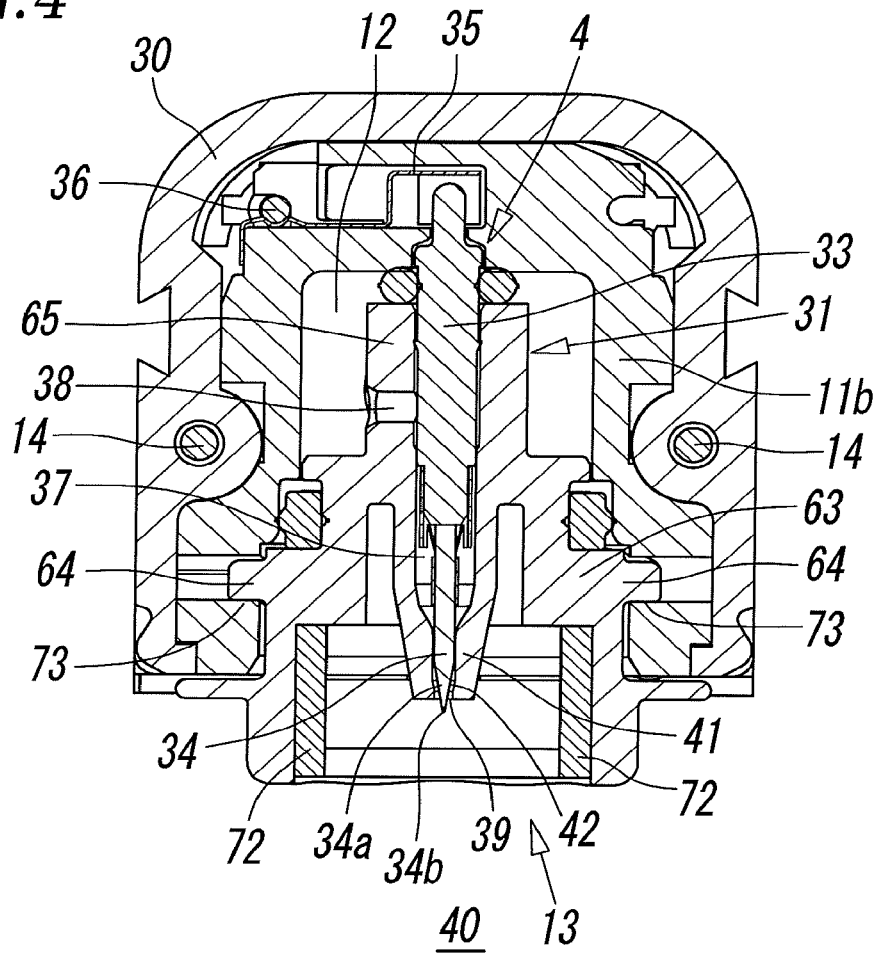
FIG. 4 is a sectional view taken along a line IV-IV in FIG. 3.

The discharge needle cartridge 13 formed as described above is attached to the body block 11 by fitting it into the cartridge attachment portion 15 that is formed in the body block 11. The attachment is performed by inserting, into the cartridge attachment portion 15, the discharge needle cartridge 13 held in an orientation different by 90 degrees from the orientation illustrated in FIG. 3 about the first axis L1, and then rotating the discharge needle cartridge 13 clockwise by 90 degrees into the orientation illustrated in FIG. 3. With that operation, as illustrated in FIG. 4, the above-described pair of engagement projections 64 and 64 are engaged respectively with a pair of engagement stepped walls 73 and 73 that are formed in an inner wall of the cartridge attachment portion 15 at opposing positions, whereby the discharge needle cartridge 13 is attached in a fixed state to the body block 11. At that time, the flange portion 66 is brought into contact with the lower surface of the body block 11, and projections 74 on an upper surface of the flange portion 66 are fitted to recesses 75 formed in the lower surface of the body block 11. Hence the discharge needle cartridge 13 is positioned in the above-described orientation.

When the discharge needle cartridge 13 is attached to the body block 11 as described above, the O-ring 70 fitted over the discharge needle 4 is interposed in a compressed state between an upper end surface 65*a* of the circular columnar portion 65 and an upper wall surface 15*a* of the cartridge attachment portion 15, thereby closing off the discharge needle accommodation chamber 37 from the air supply flow path 12. The main seal member 69 seals off a clearance between the outer periphery of the main barrel portion 63 and an inner periphery of the cartridge attachment portion 15. In addition, the auxiliary air flow inlet 38 in the lateral surface of the circular columnar portion 65 and the drive air flow introduction port 47*a* in the upper surface of the main barrel portion 63 are communicated with the air supply flow path 12.

When removing the discharge needle cartridge 13 from the body block 11, the discharge needle cartridge 13 is just required to be rotated counterclockwise by 90 degrees such that the engagement projections 64 are disengaged from the engagement stepped walls 73.

In cancelling charges on the work W with use of the ionizer 1 having the above-described structure, the AC high voltage is applied to each of the discharge needles 4 in the ionizer main unit 2 and compressed air is supplied to the air supply flow path 12 from the compressed air source 18 by operating the control panel 3. As a result, corona discharge is caused in the discharge portion 34*a* at the fore end of the discharge needle 4, and air molecules are ionized to alternately generate positive and negative ions. The generated ions are released to the external space 40 to which the needle tip 34*b* of the discharge needle 4 is exposed.

The air supplied to the air supply flow path 12 flows into the discharge needle accommodation chamber 37 from the auxiliary air flow inlet 38 of the discharge needle holder 31 under condition that a flow rate of the air is restricted, and further flows into the drive air flow hole 47 from the drive air flow introduction port 47*a* in the carrying air jet mechanism 32.

The air having flowed into the discharge needle accommodation chamber 37 flows out to the external space 40 through the auxiliary air flow gap 42 around the discharge needle body 34 little by little, and this air flow prevents contamination from adhering to the outer periphery of the discharge portion 34*a* of the discharge needle body 34.

On the other hand, the air having flowed into the drive air flow hole 47 from the drive air flow introduction port 47*a* is blown into the carrying air flow hole 52 from the drive air jet port 48 at a high speed. This brings the inside of the carrying air flow hole 52 into a negative pressure state. Therefore, the air in the external space 40 is sucked into the carrying air flow hole 52 through the ambient air suction gap 51, and is jet out from the carrying air jet port 53 toward the work W together with the drive air from the drive nozzle 45. With the jetting of the carrying air, the ions having been generated from the discharge needle 4 and released to the external space 40 are carried toward the work W in a state caught up into a jet stream of the carrying air together with the air in the external space 40. Charges on the work W are cancelled by the ions reaching the work W.

At that time, an amount of the air jetted out from the carrying air jet port 53 is increased in comparison with an amount of the drive air, and a wind speed is also increased with an increase of the air amount. Accordingly, a time taken for an air flow containing the ions to reach the work W is reduced. As a result, the ions can be efficiently carried to the charge cancellation target with a smaller consumption of air, and an attenuation time (i.e., a time required for reducing an electrostatic charged amount by 90%), which represents a performance index of the ionizer 1, can be shortened.

Figure 9:
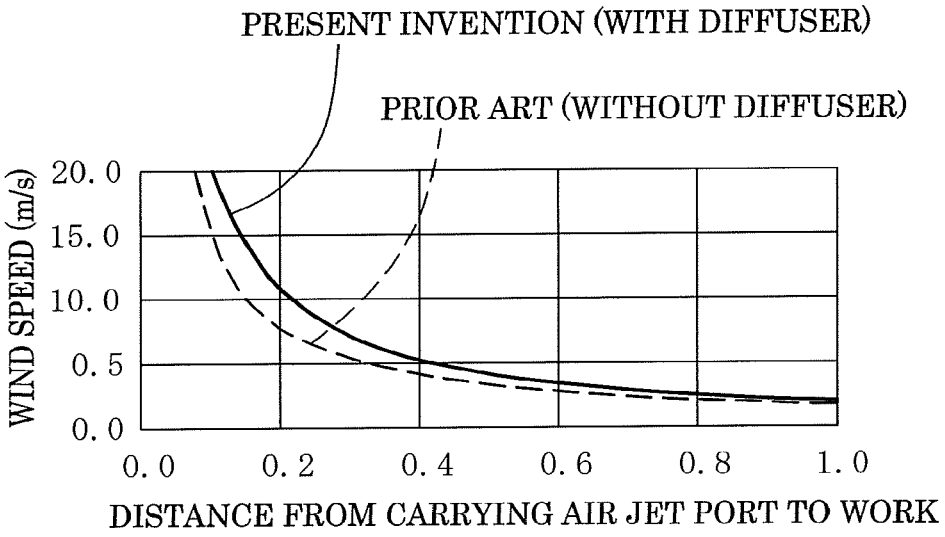
FIG. 9 is a chart representing an analysis result of wind speed.

According to an analysis result of wind speed using a computer, it is confirmed that, comparing the case having the ejector function which is given by providing, in the carrying air jet mechanism 32, the diffuser as in this embodiment and the case not including the diffuser (i.e., not having the ejector function) as in the related art, the wind speed is faster in the case having the ejector function under condition of the same consumption flow rate, as illustrated in FIG. 9.

While only one set of the carrying air jet mechanism 32 is disposed in the above embodiment, plural sets of the carrying air jet mechanisms 32 can be disposed at equal intervals around the discharge needle 4. For instance, when two sets of the carrying air jet mechanism 32 are disposed, another set of the carrying air jet mechanism can be arranged at a position denoted by a nozzle axis L2' in FIG. 3, i.e., at a position opposite to the above-described carrying air jet mechanism 32 in a left-right direction with the discharge needle 4 interposed therebetween. In other words, one set of the carrying air jet mechanism 32 may be arranged at each of bilateral symmetric positions with the discharge needle 4 interposed therebetween.

Furthermore, while, in the above embodiment, the open end of the auxiliary air flow outlet 39 and the needle tip 34*b* of the discharge needle 4 are arranged to be positioned between the ambient air suction gap 51 and the carrying air jet port 53, the open end of the auxiliary air flow outlet 39 and the needle tip 34*b* of the discharge needle 4 may be arranged to be positioned substantially at the same level as or rearward of the ambient air suction gap 51, or may be arranged to be positioned substantially at the same level as or forward of the carrying air jet port 53.

Figure 10:
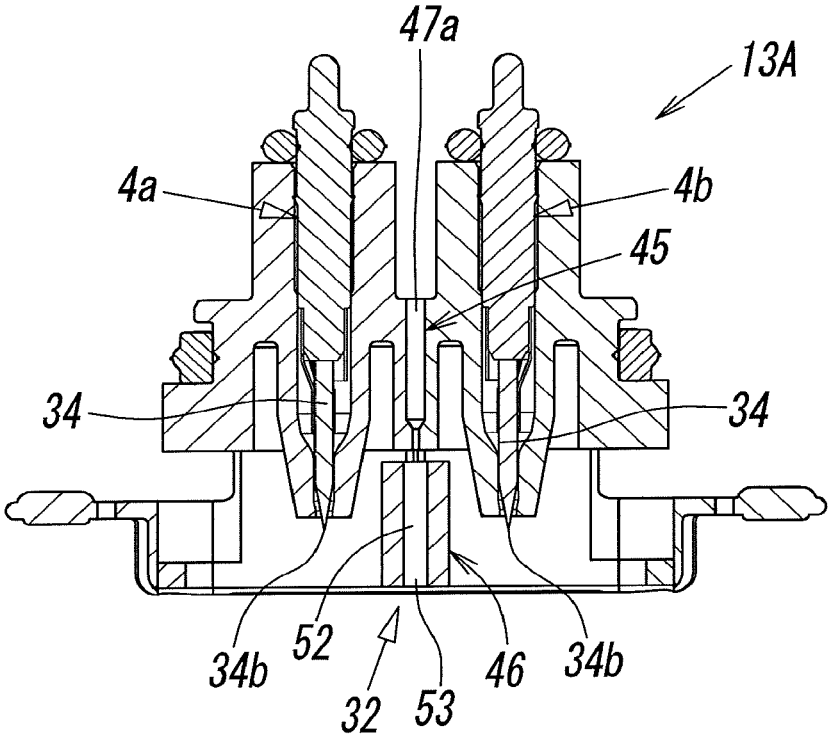
FIG. 10 is a sectional view of principal part, the view illustrating another embodiment of the ionizer according to the present invention.

Moreover, because the ionizer 1 in the above embodiment is of the AC type, the discharge needle cartridge 13 includes one discharge needle 4. However, the present invention can be further applied to an ionizer of the DC type in which a discharge needle cartridge includes two discharge needles. In such a case, as in a discharge needle cartridge 13A illustrated in FIG. 10, for example, one set of the carrying air jet mechanism 32 including the drive nozzle 45 and the diffuser 46 may be arranged at an intermediate position between two discharge needles 4*a* and 4*b* having respectively a positive pole and a negative pole. Other structures of the discharge needle cartridge 13A are substantially the same as those of the discharge needle cartridge 13 illustrated in FIG. 3. Taking into account the above, the same main components in the discharge needle cartridge 13A are denoted using the same reference signs as used in FIG. 3, and description of those components is omitted.

REFERENCE SIGNS LIST

1 ionizer
4, 4*a*, 4*b* discharge needle
10 body
11*a*, 11*b*, 11*c*, 11*d*, 11*e* body block
13, 13A discharge needle cartridge
31 discharge needle holder
32 carrying air jet mechanism
34*b* needle tip
37 discharge needle accommodation chamber
38 auxiliary air flow inlet
39 auxiliary air flow outlet
40 external space
42 auxiliary air flow gap
45 drive nozzle
46 diffuser
47*a* drive air introduction port
48 drive air jet port
51 ambient air suction gap
52 carrying air flow hole
53 carrying air jet port
61 first member
62 second member
L1 discharge needle axis (first axis)
L2 nozzle axis (second axis)
W work (charge cancellation target)

The invention claimed is:

1. An ionizer, comprising:

a discharge needle causing corona discharge and generating ions upon application of a high voltage, the discharge needle arranged along a discharge needle axis, a discharge needle holder holding the discharge needle, and a carrying air jet mechanism jetting out ion-carrying air toward a charge cancellation target, wherein the discharge needle holder includes a discharge needle accommodation chamber, an auxiliary air flow inlet in communication with a base end portion of the discharge needle accommodation chamber, and an auxiliary air flow outlet opened at a fore end portion of the discharge needle accommodation chamber to be directly communicated with an external space, the discharge needle is accommodated in the discharge needle accommodation chamber in a posture that a needle tip is exposed to the external space directly or through the auxiliary air flow outlet, and an auxiliary air flow gap extending from the auxiliary air flow inlet to the auxiliary air flow outlet is formed between an outer periphery of the discharge needle and inner peripheries of the discharge needle accommodation chamber and the auxiliary air flow outlet, and wherein the carrying air jet mechanism includes a drive nozzle having a drive air flow introduction port at a base end thereof and a drive air jet port at a fore end thereof, and a diffuser disposed in front of the drive nozzle with an ambient air suction gap interposed therebetween, the drive nozzle and the diffuser arranged along a drive nozzle axis, the drive nozzle axis disposed to be separated from and in parallel with the discharge needle axis, a carrying air flow hole having a larger diameter than the drive air jet port is formed inside the diffuser to be coaxial with the drive air jet port, and a carrying air jet port from which the carrying air is jetted out is formed at a fore end of the carrying air flow hole.

2. The ionizer according to claim 1, wherein the discharge needle axis passes a center of the discharge needle.

3. The ionizer according to claim 2, wherein the ambient air suction gap is directly communicated with the external space in all directions perpendicular to the nozzle axis, and the carrying air jet port is directly opened to the external space.

4. The ionizer according to claim 2, wherein the discharge needle is an alternate-current discharge needle alternately generating positive and negative ions upon application of an alternate-current high voltage, and one or two carrying air jet mechanisms are disposed for one discharge needle.

5. The ionizer according to claim 2, wherein the discharge needle is a direct-current discharge needle generating positive or negative ions upon application of a direct-current high voltage, and one carrying air jet mechanism is disposed for one pair of positive and negative discharge needles.

6. The ionizer according to claim 1, further comprising a first member and a second member formed separately and coupled to each other, wherein the discharge needle holder and the drive nozzle are provided in the first member, the discharge needle is held by the first member, and the diffuser is provided in the second member.

7. The ionizer according to claim 6, wherein a discharge needle cartridge is formed by the first member, the second member, and the discharge needle, and the discharge needle cartridge is detachably attached to a body of the ionizer.

8. The ionizer according to claim 7, wherein the body is formed by coupling a plurality of body blocks in series in a manner of enabling the number of coupled body blocks to be increased or decreased, and the discharge needle cartridge is attached to each of the body blocks.

* * * * *